United States Patent [19]

Komatsu

[11] 4,010,511

[45] Mar. 8, 1977

[54] MOP HAVING SLEEVE TYPE DETACHABLE MOP HEAD

[75] Inventor: Toshiyoshi Komatsu, Osaka, Japan

[73] Assignee: Duskin Franchise Co., Ltd., Osaka, Japan

[22] Filed: Feb. 6, 1976

[21] Appl. No.: 656,081

[52] U.S. Cl. ..... 15/104.94; 15/229 AC

[51] Int. Cl.[2] ..... A47L 13/24; B25G 1/00

[58] Field of Search ..... 15/115, 147 R, 147 A, 15/228, 229 AC, 229 AP, 229 BC, 104.94; 401/289

[56] References Cited

UNITED STATES PATENTS

| | | | |
|---|---|---|---|
| 3,564,635 | 2/1971 | Komai et al. | 15/229 AC X |

FOREIGN PATENTS OR APPLICATIONS

| | | | |
|---|---|---|---|
| 832,463 | 7/1938 | France | 15/147 A |
| 152,201 | 4/1932 | Switzerland | 15/147 R |

*Primary Examiner*—Daniel Blum

*Attorney, Agent, or Firm*—Sherman & Shalloway

[57] ABSTRACT

A handy mop comprising in combination (A) a mop holder including a grip, an upper holding plate and a pair of lower holding rods, all of which are integrally molded from a plastic material, each of said upper holding plate and lower holding rods extending in the horizontal longitudinal direction and having a closed end and an open end, said upper holding plate having a substantially horizontal flat lower face, said lower holding rods being disposed so that they are spaced vertically from said upper holding plate by a small distance and laterally from each other in parallel to each other by a small distance, to thereby form a horizontal mop passage between the upper holding plate and the lower holding rods and a vertical mop passage between the pair of the lower holding rods a pair of projections being disposed in the vicinity of the closed ends of the pair of the lower holding rods so that they narrow said vertical passage, and a mop-fixing engaging piece mounted on said mop holder at the position outside the closed ends of said holding plate and rods; and (B) a mop head including a tube having openings at both ends thereof, extending in a longitudinal direction and being capable of receiving said holding rods in the state inserted therein, a plurality of pairs of mop cords disposed integrally with said tube and composed of twisted yarns extending outwardly over both the ends of the tube and in the transverse direction, and a pair of loop cords fixed to the open ends of said tube; wherein said mop is attached to said mop holder by inserting the open ends of the pair of said holding rods into said tubes, engaging the pair of said loop cords with said engaging piece, projecting outwardly the rows of the mop cords on one side through said horizontal passage and projecting outwardly the rows of the mop cords on the other side through the vertical passage.

8 Claims, 12 Drawing Figures

Fig. 6-A
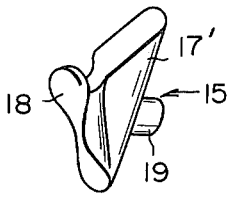
Fig. 6-B
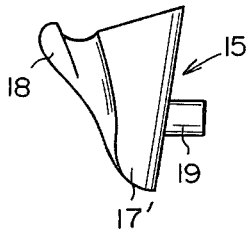
Fig. 6-C
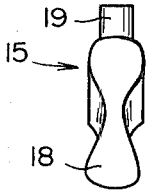
Fig. 7
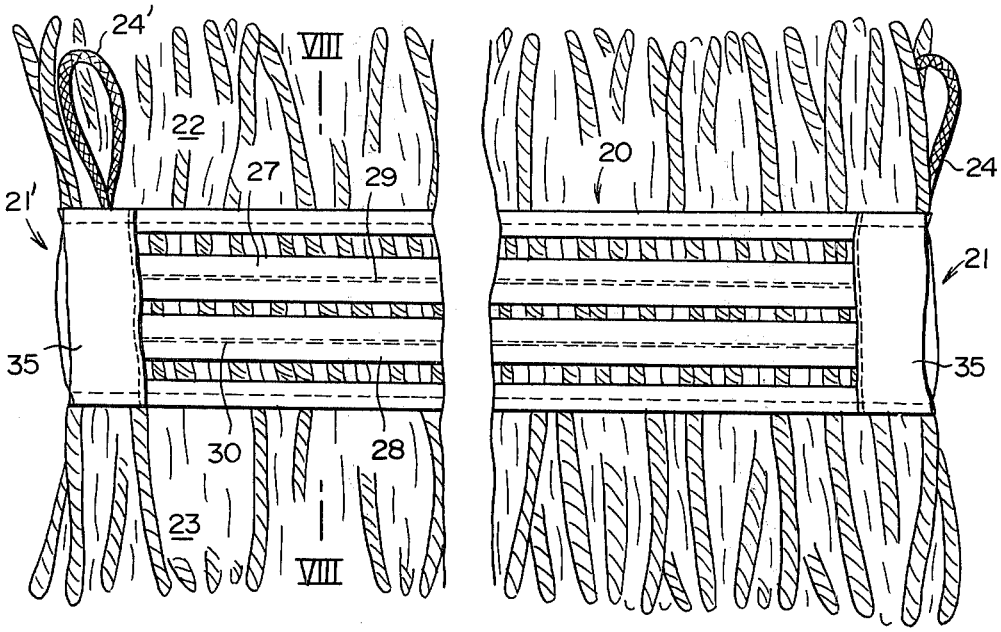
Fig. 8
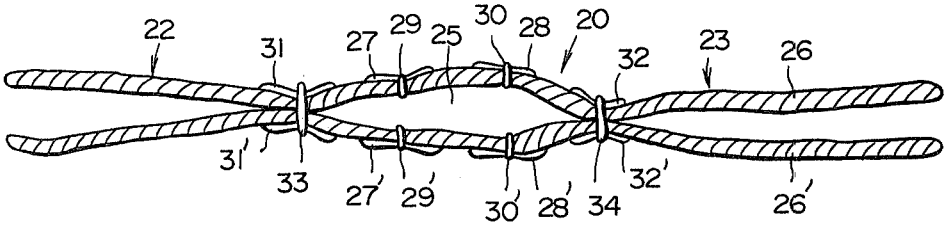

MOP HAVING SLEEVE TYPE DETACHABLE MOP HEAD

This invention relates to a light-weight handy mop suitable for dusting vehicles, furniture, walls, ceilings and the like. More particularly, the invention relates to a light-weight handy mop in which a holder and a mop head are disposed in such a relationship that they are easily attached to each other and they can be dismounted and separated from each other.

A vast number of mops including a mob held on a frame and a long handle attached thereto are known and they are used for dusting or polishing floors and the like. However, the number of known handy mops of a light weight for dusting vehicles, furniture, walls, ceilings and the like is limited.

It is a primary object of this invention to provide a light-weight and small-size handy mop which comprises a handy holder including a frame and a grip integrated therewith and a mop head of a specific structure combined with said handy holder, in which a mop head impregnated with a dusting oil composition can easily be attached and dismounted without substantial staining of the hands, and which can be readily used for dusting vehicles, furniture and the like.

Another object of this invention is to provide a light-weight and small-size handy mop in which a mop holder and a mop can easily be attached and dismounted and by which dusting can be accomplished very easily and simply.

Still another object of this invention is to provide a light-weight handy mop which includes a holder of a relatively simple structure capable of holding a mop head very tightly and which can be mass-produced on an industrial scale.

A further object of this invention is to provide a simple handy dusting tool which can be conveniently handled for dusting with one hand and has a very high practical utility.

In accordance with this invention, these objectives can be attained by a handy mop comprising in combination (A) a mop holder including a grip, an upper holding plate and a pair of lower holding rods, all of which are integrally molded from a plastic material, each of said upper holding plate and lower holding rods extending in the horizontal longitudinal direction and having a closed end and an open end, said upper holding plate having a substantially horizontal flat lower face, said lower holding rods being disposed so that they are spaced vertically from said upper holding plate by a small distance and they are spaced laterally from each other in parallel to each other by a small distance, to thereby form a horizontal mop passage between the upper holding plate and the lower holding rods and a vertical mop passage between the pair of the lower holding rods, a pair of projections being disposed in the vicinity of the closed ends of the pair of the lower holding rods so that they narrow said vertical passage, and a mop head-fixing engaging piece mounted on said mop holder at the position outside the closed ends of said holding plate and rods; and (B) a mop head including a tube having openings at both ends thereof, extending in the longitudinal direction and being capable of receiving said holding rods in the state inserted therein, a plurality of pairs of mop cords disposed integrally with said tube and composed of twisted yarns extending outwardly over both the ends of the tube and in the transverse direction, and a pair of loop cords fixed to the open ends of said tube; wherein said mop head is attached to said mop holder by inserting the open ends of the pair of said holding rods into said tubes, engaging the pair of said loop cords with said engaging piece, projecting outwardly the rows of the mop cords on one side through said horizontal passage and projecting outwardly the rows of the mop cords on the other side through the vertical passage.

Embodiments of the handy mop of this invention will now be described in detail by reference to the accompanying drawings, in which.

Figure 9:
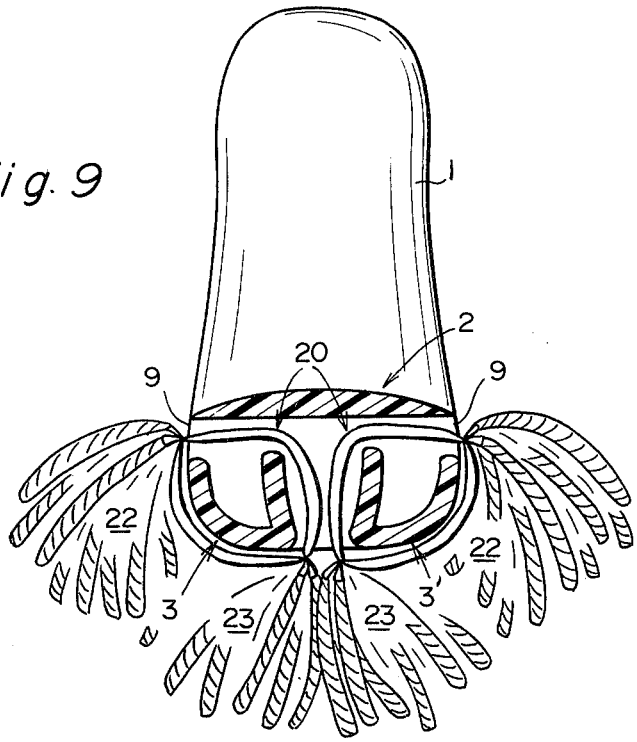
Figure 10:
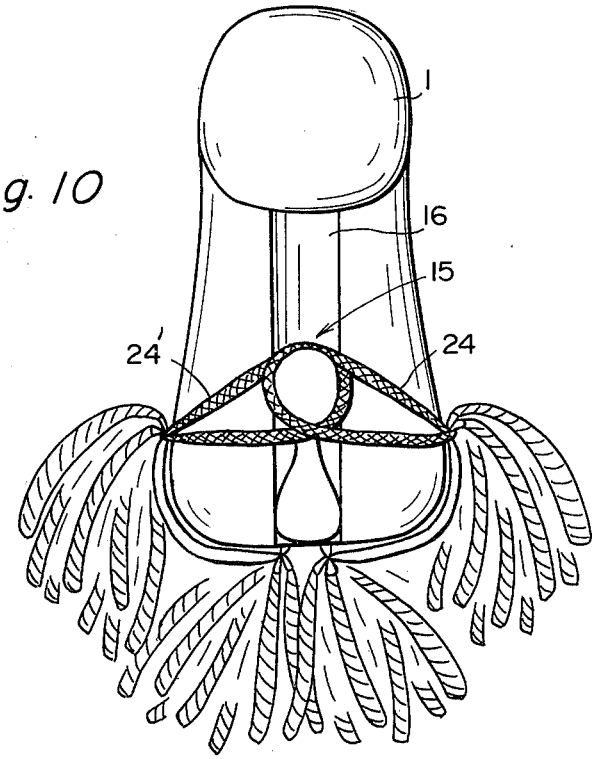

FIGS. 6-A, 6-B and 6-C are perspective, side and front views of an engaging nail member conveniently combined with the holder in the handy mop of this invention;

FIG. 7 is a top view of a mop head conveniently combined with the holder in the handy mop of this invention;

FIG. 8 is a view illustrating the section of the mop head of FIG. 7 taken along the line VIII—VIII in FIG. 8;

FIG. 9 is cross-sectional view illustrating the state of attachment of the mop head to the holder; and FIG. 10 is a back view illustrating the state of attachment of the mop head to the holder.

In the embodiment illustrated in FIGS. 1 to 5, the mop holder of this invention comprises a grip 1, an upper holding plate 2 and a pair of lower holding rods 3 and 3', and these members 1, 2, 3 and 3' are integrally molded from a plastic material, for example, a polyamide resin. Each of the upper holding plate 2 and a pair of the lower holding rods 3 and 3' extends in the longitudinal direction and has a closed end portion 4 and an open end portion 5, 6 or 6'.

Figure 1:
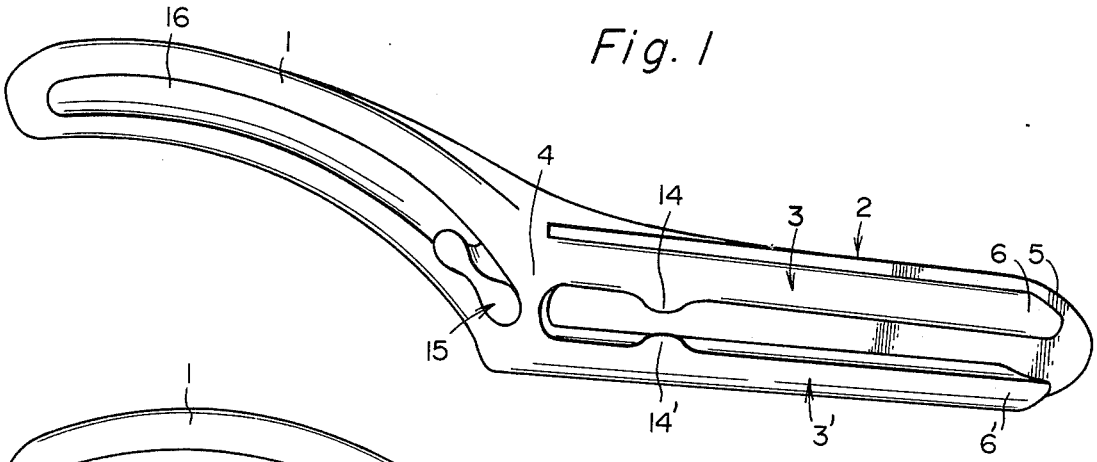
FIG. 1 is a perspective view of a holder of the handy mop of this invention seen obliquely from below.
Figure 2:
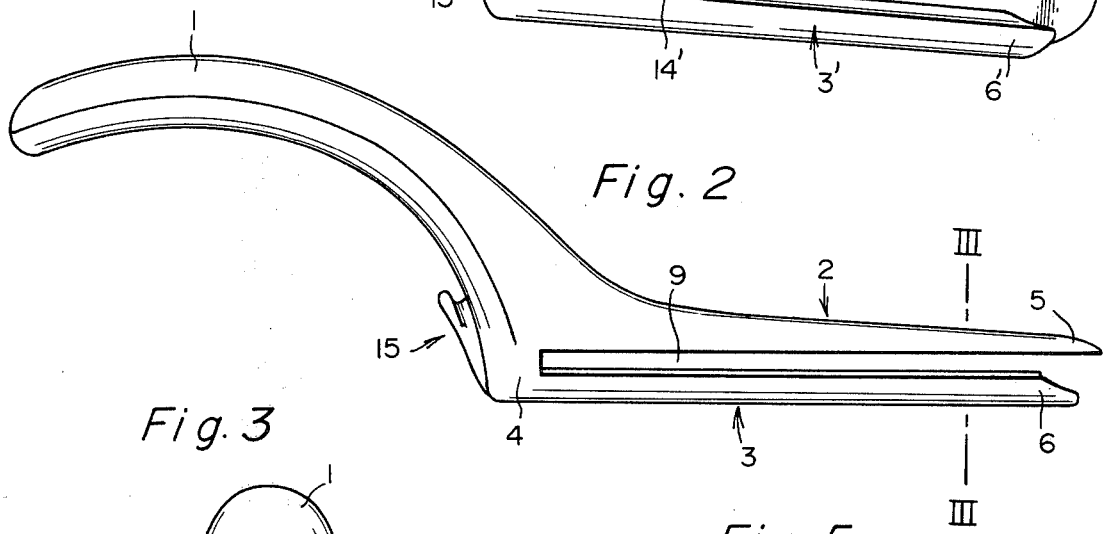
FIG. 2 is a side view of the holder shown in FIG. 1.
Figure 4:
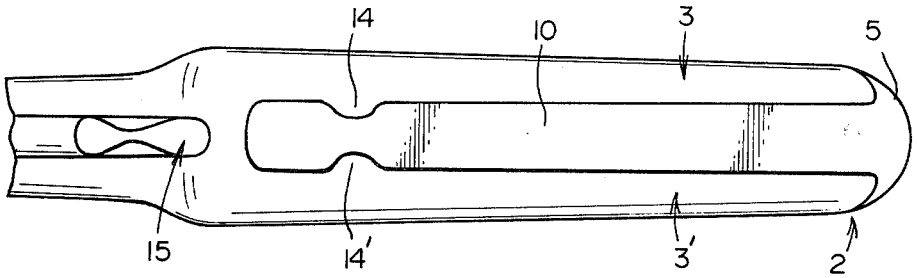
FIG. 4 is a bottom view of the holder of FIG. 1.

The holding plate 2 has a thin cylindrical shape including a substantially flat lower face 7 and a cylindrical circumferential upper face 8. It is preferred that the thickness of the plate 2 be gradually lessened toward the open end 5 from the closed connecting end 4. It is also preferred that the open end portion 5 be rounded and the upper face thereof be connected in the curved state to the flat lower face, as shown in FIGS. 2 and 4. The holding rods 3 and 3' are disposed symmetrically to each other so that they are located on the same horizontal plane with respect to the longitudinal direction and are in parallel to each other with respect to the transverse direction with a central small distance therebetween. These two holding rods 3 and 3' are spaced in the vertical direction from the lower face 7 of the plate 2 by a certain small distance. By this arrangement, a horizontal passage 9 for mop cords is formed between the upper holding plate 2 and the lower holding rods 3 and 3' as shown in FIG. 2, and a vertical passage 10 for mop cords is formed between the lower holding rods 3 and 3'.

Figure 5:
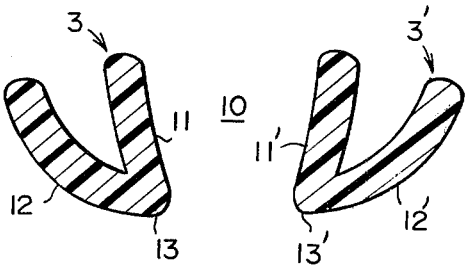
FIG. 5 is an enlarged sectional view showing the section of a holding rod of the holder of FIG. 1 taken along the direction rectangular to the lengthwise direction of the holding rod.

As is shown in FIG. 5, in an enlarged illustration, the longitudinal section of the holding rods 3 and 3', each of the rods 3 and 3′ has a substantially ν-shaped section (form resembling the shape of the Greek letter nu) through its entire length from the closed connecting end 4 to the open end portion 6 or 6′ except one part mentioned below. In short, each of the holding rods 3 and 3′ has a notched quadrantal section. Each of the holding rods 3 and 3′ may have a shape of a quadrantal cylinder, but it is preferred that each rod be shaped in a ν-figured column including a vertical inner wall 11 or 11′ and an arc-like outer wall 12 or 12′, inner walls 11 and 11′ of respective holding rods 3 and 3′ being disposed to confront each other. The columnar rod 3 or 3′ having the above-mentioned specific section has a strength much higher than that of a columnar rod having a quadrantal section. Further, since the open top ends of the inner wall 11 or 11′ and the outer wall 12 or 12′ can be bent so that both the top ends approach each other, these rods can easily be inserted into the tube when the mop head is attached to the holder. Moreover, by adoption of such structure, the weight of the holder can be greatly reduced and handling of the handy mop can be greatly facilitated.

Figure 3:
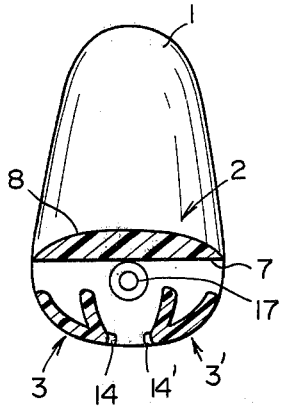
FIG. 3 is a view showing the section of the holder of FIG. 1 taken along the line III—III FIG. 2.

The rods 3 and 3′ are inserted into a tube of the mop head and have a function of holding and supporting rows of mop cords extending over both the sides of the mop head tube within the above-mentioned passages 9 and 10. In order to ensure this holding function, it is preferred that the verical walls 11 and 11′ be slightly inclined and the passage 10 be downwardly tapered as shown in FIGS. 3 and 5. When the passage 10 is tapered in this manner, the top end of the vertical wall 11 or 11′ and the top end of the arc-like wall 12 or 12′ are not positioned in the same horizontal plane but the position of the top end of the arc-like wall 12 or 12′ is slightly lower than the position of the top end of the vertical wall 11 or 11′. Accordingly, mop cords held between the lower face 7 of the holding plate 2 and the top end of the vertical wall 11 or 11′ are allowed to extend outwardly and downwardly through the top of the arc-like wall 12 or 12′, whereby the dusting operation can be performed conveniently. Moreover, both the lower edge portons 13 and 13′ are brought a little closer to each other and hence, mop cords are held more tightly between these edge portions, whereby shaking of the mop head can be prevented during the dusting operation. The top ends 6 and 6′ of the rods 3 and 3′ are made slender so that the rods 3 and 3′ can easily be inserted into the mop tube. It is possible to make the rod ends 6 and 6′ slender in a cone-like form, but in order to broaden sufficiently the clearance 9 in the open end portion 6 or 6′, it is preferred to cut the top of the end portion 6 or 6′ along the plane inclined downwardly from the clearance 9 toward the open end. By this arrangement, attachment of the mop head to the holder can be facilitated. The slenderized rod ends 6 and 6′ are preferably rounded to some extent so that they can easily be inserted into the mop tube which is usually composed of a fabric. From the practical viewpoint, it is not preferred to sharpen the rod ends 6 and 6′.

The clearance or width of the passage 10 formed between a pair of the holding rods 3 and 3′ is kept substantially equal from the closed end 4 toward the open ends 6 and 6′ except one exceptional portion, and the width of this passage is determined appropriately depending on the thickness of the bundle of the mop cords but in general, the width of this passage is at least 2 times the width of the passage 9 formed between the holding plate and the holding rods 3 and 3′.

In this invention, it is especially preferred that in holding rods 3 and 3′ extended from the connecting end portion 4, a pair of projections 14 and 14′ are formed so that the clearance of the passage 10 is abruptly narrowed in the vicinity of the connecting portion 4. These projections 14 and 14′ are arranged in the lower end portions of vertical walls 11 and 11′, respectively, and at positions equal to each other with respect to the distance from the connecting portion 4. These projections 14 and 14′ have such a mountain-like shape that the tops of the projections face each other with a narrowed distance therebetween. The narrowest width of the passage 10, namely the distance between the facing tops of the projections 14 and 14′, is preferably about 2 times the width of the passage 9 formed between the holding plate 2 and the holding rods 3 and 3′. These projections may have a plate-like shape in which the lower face has at the end portions thereof extensions made in agreement with the arc-like walls 12 and 12′, respectively, though the projections can be gradually tapered toward the tops thereof as pointed above. At any rate, it is not preferred that these mountain-like projections extend up to the top portions of the vertical walls 11 and 11′. If these mountain-like projections 14 and 14′ are formed, the mop strands are held very tightly in the narrowed clearance between the projections 14 and 14′ and falling-out, turning or loosening of the set mop can be effectively prevented during the use. Moreover, by provision of such projections, the width of the passage 10 between the holding rods can be broadened at other portions, and hence, setting and dismounting of the mop can be greatly facilitated. In view of the fact that forces are readily imposed on the end portions during the dusting operation, it is preferred that the clearance be slightly broadened at the open end portions 6 and 6′ of the holding rods 3 and 3′.

In the handy mop of this invention, the grip 1 is integrally connected with the connecting portion of the holder of the above structure. The grip 1 is located above the horizontal plane of the holding plate 2. The grip 1 may be disposed rightly above the holding plate 2 or in the rear of the holding plate 2 and above the holding plate 2. The size and configuration of the grip 1 are so determined that it can be clasped easily with one hand and the cleaning operation can be comfortably performed. However, the grip 1 should have a strength sufficient to resist the dusting operation, and it is preferred that the grip 1 be not too long.

In the embodiment shown in the drawings, the grip 1 extends in the rear of the connecting end portion, and a groove 16 having a U-shaped section is formed to extend in the lengthwise direction of the grip 1.

In view of the structure of the mop head, which will be detailed hereinafter, it is preferred that a nail-like engaging piece 15 be disposed on the outside (rear) of the connecting end portion 4 of the mop holder so that a pair of loop strings attached to both the end portions of the mop head can be hooked on to this engaging piece 15. In this invention, any means can be adopted for fixing both the end portions of the mop to the rear portion of the holder. For example, each end portion can be tied and fixed to the holder by a string or cord. In view of the ease of handling, it is preferred that loop cords 24, 24′ (FIG. 7) having certain flexibility be attached to each end portion of the mop head and be hung on the engaging piece 15 to thereby fix the mop head to the holder.

As such, loop cords having a flexibility or contractibility formed by knitting several to ten wooly nylon yarns, are most preferred. Further, ropes formed by knitting fibers having oil resistance and flexibility can be conveniently used. These preferred properties may also be added by knitting crimped yarns such as wooly nylon yarns or by using hoisery knitted articles or the like.

The size or configuration of the engaging piece 15 is not critical, as far as such hung strings can easily be taken off from the engaging piece 15, and the engaging piece 15 is so designed that it can be prepared and handled with convenient ease. It is preferred that the positions where the strings are hung for fixation of the mop head be above the extensions of the passage 9 formed between the holding plate 2 and the holding rods 3 and 3'.

As the engaging piece 15, there is preferably employed a molded article comprising, as shown in FIGS. 6-A to 6-C, a substrate 17', a string hanging nail 18 projected from the substrate and a projection 19 extending in the direction opposite to the projecting direction of the string-hanging nail 18.

This molded article 15 is inserted into the concave groove 16 formed at the center of the lower face of the grip 1 in the lengthwise direction thereof as a rib for reducing the weight of the entire holder and improving the strength of the grip. In this manner, a string-hanging nail member in conveniently provided. In this case, a small hole 17 (see FIG. 3) is perforated on the bottom face of the concave groove 16, preferably through the closed end of the passage 10, and the projection 19 is inserted and fixed in this small hole 17, preferably with use of an adhesive, whereby the string-hanging nail 18 can be formed tightly and integrally with the holder. Instead of separately attaching the molded engaging piece 15 including the nail 18, a suitable hanging nail member 15 may be formed integrally with the holder at the above-mentioned position when the holder is molded.

As is illustrated in FIGS. 7 and 8, the mop head to be attached to the holder having the above-mentioned structure has at both the ends thereof openings 21 and 21' and includes a tube 20 extending in the longitudinal direction, a pair of rows 22 and 23 of mop cords composed of twisted yarns and extending outwardly of each side of the tube 20 in the transverse direction, and a pair of loop cords 24 and 24' fixed to the open ends 21 and 21' of the tube 20, respectively.

The tube 20 has in the interior thereof an inner passage 25 into which the holding rods 3 and 3' can be inserted.

The mop head is formed, as in the case of ordinary mops, by sewing integrally a plurality of rows of mop cords. For example, as is illustrated in FIG. 8, mop cords 26 and 26' arranged densely in two rows piled in the same direction on one plane are sewn by stiches 29 and 30 and 29' and 30' together with two pairs of cloth tapes 27 and 28 and 27' and 28' crossing the central portions of the rows 26 and 26', respectively. Two of the so sewn mop cord rows 26 and 26' are piled together, and a pair of tapes 31 and 32 and another pair of tapes 31' and 32' are applied to the back and front of the piled assembly, respectively, at the central portions thereof in the longitudinal direction of the assembly. In this state, stiches 33 and 34 are formed at facing tapes 31 and 32 and 31' and 32', respectively, whereby a tube 20 is formed in the central portion and rows of mop cords 22 and 23 are formed outwardly of the tube 20. The length of the tube 20 is a little longer than the sum of the lengths of the holding rods 3 and 3' of the holder, and the holding rods 3 and 3' are inserted from both the open ends of the tube 20, respectively and they are disposed in the tube 20 so that the closed ends of the rods are just positioned at both the ends of the tube 20, respectively. In order to reinforce the open ends 21 and 21' of the tube 20, it is preferred that tapes 35 and 35' be sewn to the open ends 21 and 21', respectively.

Mop cords 26 and 26' of twisted yarns of cellulose fibers such as those of cotton and mercerized cotton are preferably employed.

In order to dust of furniture, vehicles, walls and the like easily and conveniently, it is preferred that the mop head to be used in this invention be impregnated with a dusting oil composition. Such dusting oil composition comprises, for example, a major amount of a mineral oil, a minor amount of a cationic or amphoteric surface active agent, and a very small amount of a fungicidal agent.

The mop head which has been used for dusting during a certain period is taken off from the holder and replaced by a washed mop impregnated afresh with a dusting oil composition.

When the mop head is attached to the mop holder, ends 6 and 6' of the holding rods 3 and 3' of the holder are inserted in the openings 21 and 21' of the tube 20 and the rods 3 and 3' are completely contained in the tube 20, as shown in FIG. 9. In this case, rows 22 are projected outwardly through the horizontal passages 9 of the holder and rows 23 are projected outwardly through the vertical passage 10.

The pair of loop cords 24 and 24' attached to the openings 21 and 21' of the mop tube 20 are engaged with the engaging piece 15 on the rear end portion of the holder, as shown in FIG. 10, whereby the cords 24 and 24' are fixed to the holder.

When the mop is taken off from the holder, the above procedures are repeated in reverse order. Thus, in this invention, attachment of the mop to the holder and dismounting of the mop from the holder can be performed very easily and assuredly.

What I claim is:

1. A handy mop comprising in combination (A) a mop holder including a grip, an upper holding plate and a pair of lower holding rods, all of which are integrally molded from a plastic material, each of said upper holding plate and lower holding rods extending in the horizontal longitudinal direction and having a closed end and an open end, said upper holding plate having a substantially horizontal flat lower face, said lower holding rods being disposed so that they are spaced vertically from said upper holding plate by a small distance and laterally from each other in parallel to each other by a small distance, to thereby form a horizontal mop passage between the upper holding plate and the lower holding rods and a vertical mop passage between the pair of the lower holding rods, a pair of projections being disposed in the vicinity of the closed ends of the pair of the lower holding rods so that they narrow said vertical passage, and a mop head-fixing engaging piece mounted on said mop holder at a position outside the closed ends of said holding plate and rods; and (B) a mop head including a tube open at each end, extending in the longitudinal direction and being capable of receiving said holding rods in the state inserted therein, a plurality of rows of mop cords disposed integrally with said tube and composed of twisted yarns extending outwardly of both sides of the tube in the transverse direction, and a loop cord fixed to each of the open ends of said tube; wherein said mop is attached to said mop holder by inserting the open ends of the pair of said holding rods into the open ends of said tube, engaging the pair of said loop cords with said engaging piece, projecting outwardly the rows of the mop cords on one side through said horizontal passage and projecting outwardly the rows of the mop cords on the other side through the vertical passage.

2. A handy mop as set forth in claim 1 wherein each of the upper holding plate and the lower holding rods has at the free ends a circular configuration.

3. A handy mop as set forth in claim 1 wherein each of the pair of the holding rods has an inner vertical wall and an outer arc-like wall and has a section resembling a Greek figure $\nu$(nu).

4. A handy mop as set forth in claim 3 wherein said vertical passage is tapered downwardly and is formed between the facing inner vertical walls of the pair of the lower holding rods.

5. A handy mop as set forth in claim 3 wherein the top portions of the arc-like walls of the pair of the lower holding rods are disposed at positions lower than the top portions of the vertical walls of the holding rods.

6. A handy mop as set forth in claim 1 wherein the vertical passage has a width at least two times the width of the horizontal passage.

7. A handy mop as set forth in claim 1 wherein the mop is composed of cords of twisted yarns of cellulose fibers impregnated with a dusting oil composition.

8. A handy mop as set forth in claim 1 wherein the mop is formed by piling two mop cord rows in the longitudinal direction and in the central portion thereof and sewing the piled mop cord rows with laterally spaced line of stitching so that the tube for inserting the holding rods therein is formed at the center of the sewn assembly and the rows of the mop cords are projected outwardly of both sides of said tube.

* * * * *